United States Patent [19]

Townsend

[11] Patent Number: 4,998,651

[45] **Date of Patent: * Mar. 12, 1991**

[54] RING NEEDLE PUSHER

[75] Inventor: Blue H. Townsend, Bartlesville, Okla.

[73] Assignees: John D. Gassett; Paul H. Johnson, Tulsa, Okla. ; part interest to each

[ * ] Notice: The portion of the term of this patent subsequent to Feb. 13, 2007 has been disclaimed.

[21] Appl. No.: 463,159

[22] Filed: Jan. 10, 1990

Related U.S. Application Data

[63] Continuation of Ser. No. 271,333, Nov. 9, 1988, which is a continuation of Ser. No. 158,120, Feb. 16, 1988, abandoned, which is a continuation of Ser. No. 36,105, Apr. 8, 1987, abandoned.

[51] Int. Cl.[5] ..... D05B 91/04

[52] U.S. Cl. ..... 223/101

[58] Field of Search ..... 2/21; 223/101

[56] References Cited

U.S. PATENT DOCUMENTS

| | | | |
|---|---|---|---|
| 72,751 | 12/1867 | Niles | 223/101 |
| 1,379,777 | 5/1921 | Oijerholm | 223/101 |
| 1,539,434 | 5/1925 | Schubert | 223/101 |
| 2,113,994 | 4/1938 | Odom | 223/101 |

*Primary Examiner*—Werner H. Schroeder
*Assistant Examiner*—Paul C. Lewis
*Attorney, Agent, or Firm*—Head & Johnson

[57] ABSTRACT

A needle pushing head is made integral with a ring for wearing on a finger. The head has at least one needle receiving indentation so that the needle can be placed therein and forced by the finger through cloth or other material.

2 Claims, 1 Drawing Sheet

RING NEEDLE PUSHER

This is a continuation of application Ser. No. 271,333, filed Nov. 9, 1988, for "Ring Needle Pusher", which is a continuation of application Ser. No. 158,120, filed Feb. 16, 1988 (abandoned); which is a continuation of application Ser. No. 036,105, filed Apr. 8, 1987 (abandoned).

BACKGROUND OF THE INVENTION

This invention relates to devices to be worn on the fingers for pushing needles with thread through material such as when sewing buttons on coats.

It is, of course, quite common to sew with a needle having a thread passed through the eye of the needle. This sewing may be for many purposes, such as for sewing buttons on a piece of cloth, sewing two pieces of material together, etc. It is, of course, well known that sewing through some material is quite simple. However, as the material gets firmer or thicker it becomes more difficult to push the needle through the material. For ages, seamstresses and sewers have used a thimble on one finger to aid in pushing the needle through the material. These thimbles are essentially little cups with a plurality of identations thereon and which fit over the end of the finger. While these thimbles are quite useful and have been used quite successfully, they do prevent one from using the tip of the finger on which the thimble is placed.

It is therefore an object of this invention to provide a device to be worn on the finger for pushing needles through materials that do not restrict the use of the tip of the finger.

SUMMARY OF THE INVENTION

This is a device to be worn on a finger for pushing a needle and thread through material. It includes a ring which is to be worn on a finger, preferably on the index finger. A needle pushing head is mounted on the outer periphery of the ring. The head is preferably block-like and made an integral part of the ring. The head has a needle receiving indentation which has an axis approximately perpendicular to the plane of the ring.

In operation, the sewing needle is threaded in the usual manner and the material is positioned as one would normally do in sewing. Preferably, the needle pusher is placed on the index finger of the right hand if one is right handed, or the left hand for left handed people. The needle is grasped by the thumb and tip of the index finger and placed in the position in which it is to enter the material. Then the eye end of the needle is placed in the needle receiving indentation of the head. Force is then applied by the finger to force the needle through the material.

In another embodiment the needle pushing head is modified so that it includes a cylindrical member welded or otherwise secured to the ring and with the axis of the cylinder approxiately parallel to the axis of the ring. A backing plate is provided on one side of the needle receiving cylinder.

DETAILED DESCRIPTION OF THE PREFERRED EMBODIMENT

Figure 2:
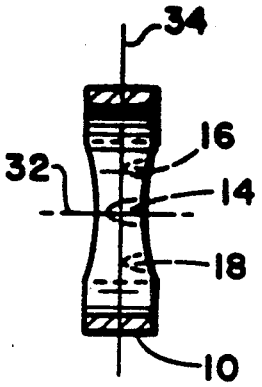
FIG. 2 is a view taken along the line 2—2 of FIG. 1.
Figure 1:
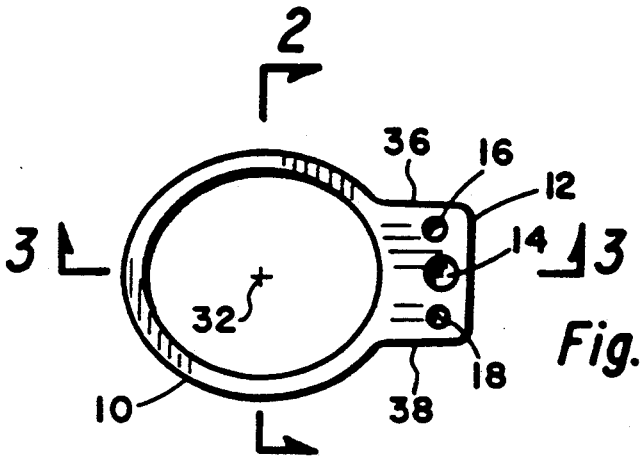
FIG. 1 illustrates an elevation view of the preferred embodiment of the needle pusher.
Figure 3:
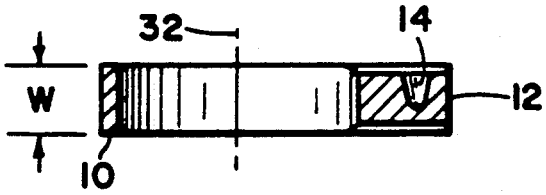
FIG. 3 is a view taken along the line 3—3 of FIG. 1.

Attention is first directed to FIGS. 1, 2, and 3. Shown thereon is a ring 10 with a needle pushing head 12 made integral therewith. The ring 10 is generally circular shaped and has an axis 32 in the center thereof. The ring has what may be called a ring plane which is perpendicular to the axis 32 and would pass generally along the line 34 of FIG. 2.

The needle pushing head 12 has main needle receiving indentation 14 and secondary needle receiving indentations 16 and 18. The indentation 14 is essentially in the middle of the forward face 13 of needle pushing head 12 between sides 36 and 38. The rear face 15 of head 12 is indicated in FIG. 3. The top of head 12 is indicated by reference number 17. Typically the width of main needle receiving indentation 14 is sufficiently large to receive the end of a needle and would normally be not over about three millimeters. The width W of the ring, illustrated in FIG. 3, is typically about six millimeters. These are merely typical dimensions and are not meant to be limited thereby. The device can be made of any material which will be comfortable to the wearer and of sufficient strength, rigidity and of abrasion resistance so that it can push the needle through the material. Typical material from which to make the ring and head includes pewter and silver.

Figure 4:
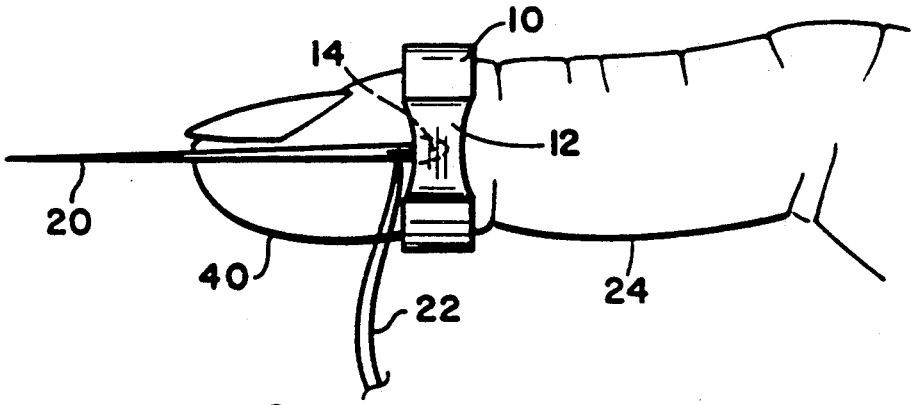
FIG. 4 shows the needle pusher of my invention placed upon the finger of the sewer.

Attention is next directed to FIG. 4 which shows the needle pusher of my device as it would normally be worn. The ring 10 is slipped on to the end of finger 24 which for most people would normally be the index finger. I have found that it is best that the ring 10 fits snugly up against the first joint of the finger but will not pass thereover. I then place the sewing needle 20 with thread 22 in indentation 14. Needle 20 is directed with the thumb and the tip 40 of finger 24 to the proper position on the material being sewed and is forced therethrough by applying force on needle 20 through head 12 and ring 10 from force by the finger 24. I have found that this is especially useful for pushing sewing needles through tough material such as leathers, canvass, plastic and so forth.

Figure 5:
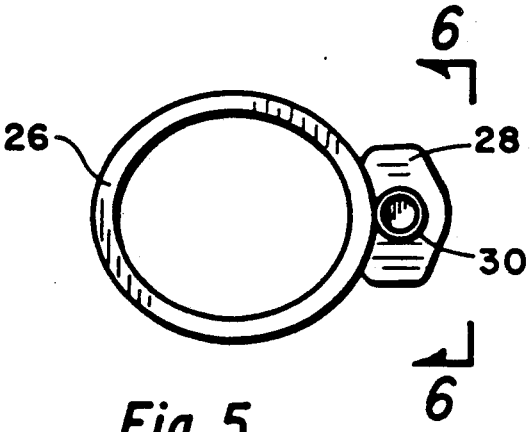
FIG. 5 is another embodiment of my invention showing a needle receiving cylindrical element attached to the ring.
Figure 6:
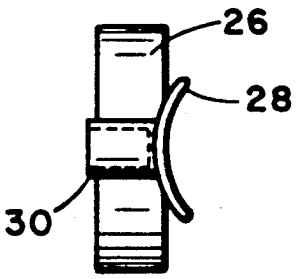
FIG. 6 is a view taken along the line 6—6 of FIG. 5.

Attention is next directed to FIGS. 5 and 6 which show another embodiment of my invention. Shown therein is a ring portion 26 having a needle receiving cylinder 30 attached to the periphery of the ring 26 such as by soldering or welding or whatever may be appropriate for the material being used. One end of cylinder 30 is closed by a back up plate 28. The selection of the material as described above in regard to FIGS. 1, 2 and 3 likewise applied to this embodiment. In an operation the sewing needle is inserted into needle receiving cylinder 30 and force applied somewhat similarly to that described in regard to FIG. 4.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A ring thimble sewing accessory for use in directly pushing a needle comprising:

a ring for wearing on a finger, said ring having a circumference, and a width "w", a front ring plan and a back ring plane and of such size to be located between the end of the finger and the first joint thereof, the size and shape of said ring along the front ring plane being substantially the same as along the back ring plane;

a needle pushing head having a forward face, a rear face, and a top, and made an integral part of said ring, said head extending only along a portion of said circumference and being of no greater width than the width "w" of the rest of the ring, no portion of said needle pushing head extending beyond said front ring plane or beyond said back ring plane, a needle receiving indentation in the forward face of said head, said indentation having an axis substantially perpendicular to said ring plane such that the needle may be pushed in direct contact with said indentation in a direction parallel to said axis.

2. A ring thimble sewing accessory for use in directly pushing a needle comprising:

a ring of uniform diameter for wearing on a finger having a first joint and of such size as to be worn between the end of the finger and said first joing, said ring having a circumference, a front ring plane, a rear ring plane and an axis perpendicular to said front ring plane;

said ring having a rigidly protruding portion along only a part of said circumference to form a needle pushing head having a top, a forward and a rear face and made an integral part of said ring, said portion having at least one receiving indentation in its forward face, said indentation having an axis parallel to said axis such that the needle may be pushed in a direction parallel to said axis, said radially protruding portion being of no greater thickness than that of the rest of the ring.

* * * * *